US007854496B2

(12) United States Patent
McAvoy et al.

(10) Patent No.: US 7,854,496 B2
(45) Date of Patent: Dec. 21, 2010

(54) INKJET PRINTER WITH SMALL DROP SIZE

(75) Inventors: Gregory John McAvoy, Balmain (AU); Vincent Patrick Lawlor, Balmain (AU); Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 269 days.

(21) Appl. No.: 12/239,816

(22) Filed: Sep. 29, 2008

(65) Prior Publication Data

US 2010/0079549 A1 Apr. 1, 2010

(51) Int. Cl.
*B41J 2/04* (2006.01)

(52) U.S. Cl. ..... 347/54

(58) Field of Classification Search ..... 347/54, 347/50, 56–59, 61–65, 40, 43, 44, 47, 20, 347/68, 75

See application file for complete search history.

(56) References Cited

U.S. PATENT DOCUMENTS 6,460,980 B1 * 10/2002 Hegedus et al. ..... 347/68
7,484,836 B2 * 2/2009 Moynihan ..... 347/47
2002/0171714 A1 11/2002 Silverbrook
2003/0103106 A1 6/2003 Silverbrook
2007/0273726 A1 * 11/2007 Rosenblum et al. ..... 347/47
2008/0316278 A1 * 12/2008 Van Den Bergen ..... 347/65

FOREIGN PATENT DOCUMENTS

EP 1419991 A2 5/2004

* cited by examiner

*Primary Examiner*—K. Feggins

(57) ABSTRACT

An inkjet printer configured for ejecting ink droplets having a volume in the range of 1 to 2.5 pL, the printer comprising: a printhead having a plurality of nozzles assemblies, each nozzle assembly comprising: a nozzle chamber for containing ink, the chamber having a nozzle opening and an ink inlet, the nozzle opening having a maximum dimension in the range of 4 to 12 microns; and a bend actuator for ejecting ink droplets from the nozzle opening by generating a positive pressure pulse in the ink during bending of the actuator; and an ink supply system configured for supplying ink to the printhead at a positive hydrostatic pressure in the range of 1 to 300 mm $H_2O$.

20 Claims, 5 Drawing Sheets

INKJET PRINTER WITH SMALL DROP SIZE

FIELD OF THE INVENTION

This invention relates to inkjet nozzle assemblies. It has been developed primarily to improve the efficiency of thermal bend actuated inkjet nozzles and to improve drop ejection characteristics.

CROSS REFERENCES

The following patents or patent applications filed by the applicant or assignee of the present invention are hereby incorporated by cross-reference.

| | | | | | | |
|---|---|---|---|---|---|---|
| 7,344,226 | 7,328,976 | 11/685,084 | 11/685,086 | 11/685,090 | 11/740,925 | 11/763,444 |
| 11/763,443 | 11,946,840 | 11,961,712 | 12/017,771 | 11/607,976 | 11/607,975 | 11/607,999 |
| 11/607,980 | 11/607,979 | 11/607,978 | 11/735,961 | 11/685,074 | 11/696,126 | 11/696,144 |
| 7,384,131 | 11/763,446 | 6,665,094 | 7,416,280 | 7,175,774 | 7,404,625 | 7,350,903 |
| 11/293,832 | 12,142,779 | 11/124,158 | 6,238,115 | 6,390,605 | 6,322,195 | 6,612,110 |
| 6,480,089 | 6,460,778 | 6,305,788 | 6,426,014 | 6,364,453 | 6,457,795 | 6,315,399 |
| 6,755,509 | 11/763,440 | 11/763,442 | 12,114,826 | 11/246,687 | 7,156,508 | 7,303,930 |
| 7,246,886 | 7,128,400 | 7,108,355 | 6,987,573 | 10/727,181 | 6,795,215 | 7,407,247 |
| 7,374,266 | 6,924,907 | 11/544,764 | 11/293,804 | 11/293,794 | 11/293,828 | 11/872,714 |
| 10/760,254 | 7,261,400 | 11/583,874 | 11/782,590 | 11/014,764 | 11/014,769 | 11/293,820 |
| 11/688,863 | 12,014,767 | 12,014,768 | 12,014,769 | 12,014,770 | 12,014,771 | 12,014,772 |
| 11/482,982 | 11/482,983 | 11/482,984 | 11/495,818 | 11/495,819 | 12,062,514 | 12,192,116 |
| 7,306,320 | 10/760,180 | 6,364,451 | 7,093,494 | 6,454,482 | 7,377,635 | |

BACKGROUND OF THE INVENTION

The present Applicant has described previously a plethora of MEMS inkjet nozzles using thermal bend actuation. Thermal bend actuation generally means bend movement generated by thermal expansion of one material, having a current passing therethough, relative to another material. The resulting bend movement may be used to eject ink from a nozzle opening, optionally via movement of a paddle or vane, which creates a pressure wave in a nozzle chamber.

Some representative types of thermal bend inkjet nozzles are exemplified in the patents and patent applications listed in the cross reference section above, the contents of which are incorporated herein by reference.

The Applicant's U.S. Pat. No. 6,416,167 describes an inkjet nozzle having a paddle positioned in a nozzle chamber and a thermal bend actuator positioned externally of the nozzle chamber. The actuator takes the form of a lower active beam of conductive material (e.g. titanium nitride) fused to an upper passive beam of non-conductive material (e.g. silicon dioxide). The actuator is connected to the paddle via an arm received through a slot in the wall of the nozzle chamber. Upon passing a current through the lower active beam, the actuator bends upwards and, consequently, the paddle moves towards a nozzle opening defined in a roof of the nozzle chamber, thereby ejecting a droplet of ink. An advantage of this design is its simplicity of construction. A drawback of this design is that both faces of the paddle work against the relatively viscous ink inside the nozzle chamber.

The Applicant's U.S. Pat. No. 6,260,953 describes an inkjet nozzle in which the actuator forms a moving roof portion of the nozzle chamber. The actuator takes the form of a serpentine core of conductive material encased by a polymeric material. Upon actuation, the actuator bends towards a floor of the nozzle chamber, increasing the pressure within the chamber and forcing a droplet of ink from a nozzle opening defined in the roof of the chamber. The nozzle opening is defined in a non-moving portion of the roof. An advantage of this design is that only one face of the moving roof portion has to work against the relatively viscous ink inside the nozzle chamber. A drawback of this design is that construction of the actuator from a serpentine conductive element encased by polymeric material is difficult to achieve in a MEMS fabrication process.

The Applicant's U.S. Pat. No. 6,623,101 describes an inkjet nozzle comprising a nozzle chamber with a moveable roof portion having a nozzle opening defined therein. The moveable roof portion is connected via an arm to a thermal bend actuator positioned externally of the nozzle chamber. The actuator takes the form of an upper active beam spaced apart from a lower passive beam. By spacing the active and passive beams apart, thermal bend efficiency is maximized since the passive beam cannot act as heat sink for the active beam. Upon passing a current through the active upper beam, the moveable roof portion, having the nozzle opening defined therein, is caused to rotate towards a floor of the nozzle chamber, thereby ejecting through the nozzle opening. Since the nozzle opening moves with the roof portion, drop flight direction may be controlled by suitable modification of the shape of the nozzle rim. An advantage of this design is that only one face of the moving roof portion has to work against the relatively viscous ink inside the nozzle chamber. A further advantage is the minimal thermal losses achieved by spacing apart the active and passive beam members. A drawback of this design is the loss of structural rigidity in spacing apart the active and passive beam members.

Hitherto, it was understood that inkjet nozzles of the type actuated by a bend actuator were required to displace a requisite volume of ink in order to eject ink droplets of a predetermined volume from a nozzle opening. Hence, inkjet nozzle designs focused primarily on providing maximal displacement of a thermal bend actuator for a given energy input.

There is a need to improve on the bend actuation efficiency of thermal bend actuators whilst allowing denser nozzle packing in inkjet printheads and optimizing drop ejection characteristics.

SUMMARY OF THE INVENTION

In a first aspect the present invention provides an inkjet nozzle assembly comprising:

- a nozzle chamber for containing ink, said chamber having a nozzle opening and an ink inlet;
- a pair of electrical contacts positioned at one end of said assembly and connected to drive circuitry; and
- a thermal bend actuator for ejecting ink through the nozzle opening, said actuator comprising:

an active beam connected to said electrical contacts and extending longitudinally away from said contacts, said active beam defining a bent current flow path between said contacts; and a passive beam fused to said active beam, such that when a current is passed through the active beam, the active beam heats and expands relative to the passive beam resulting in bending of the actuator, wherein said actuator has a working face for generating a positive pressure pulse in said ink during said bending of said actuator, said working face having an area of less than 800 square microns.

Optionally, said working face has an area of less than 600 microns.

Optionally, said working face is defined by a face of said passive beam.

Optionally, is configured to provide a peak actuator velocity of at least 2.5 m/s.

Optionally, said drive circuitry is configured to deliver actuation pulses to said active beam, each actuation pulse delivering less than 200 nJ of energy to said active beam.

Optionally, said drive circuitry is configured to deliver actuation pulses to said active beam, each actuation pulse having a pulse width of less than 0.2 microseconds.

Optionally, said active and passive beams each have a length of less than 50 microns.

Optionally, said active and passive beams each have a width of less than 15 microns.

Optionally, said active and passive beams have a combined thickness of at least 1.5 microns.

Optionally, said active beam comprises a first arm extending longitudinally from a first contact, a second arm extending longitudinally from a second contact and a connecting member connecting said first and second arms.

Optionally, each of said first and second arms comprises a respective resistive heating element having a width of less than 5 microns.

Optionally, said connecting member interconnects distal ends of said first and second arms, said distal ends being distal relative to said electrical contacts.

Optionally, said active beam is comprised of a material selected from the group comprising: titanium nitride, titanium aluminium nitride and a vanadium—aluminium alloy.

Optionally, said passive beam is comprised of a material selected from the group comprising: silicon dioxide, silicon nitride and silicon oxynitride.

Optionally, the nozzle chamber comprises a floor and a roof having a moving portion, whereby actuation of said actuator moves said moving portion towards said floor.

Optionally, said moving portion comprises said actuator.

Optionally, the nozzle opening is defined in the moving portion, such that the nozzle opening is moveable relative to the floor.

Optionally, said inkjet nozzle assembly has a footprint area of less than 1500 square microns.

In another aspect the present invention provides an inkjet printhead comprising a plurality of nozzle assemblies, each assembly comprising:

a nozzle chamber for containing ink, said chamber having a nozzle opening and an ink inlet;

a pair of electrical contacts positioned at one end of said assembly and connected to drive circuitry; and a thermal bend actuator for ejecting ink through the nozzle opening, said actuator comprising:

an active beam connected to said electrical contacts and extending longitudinally away from said contacts, said active beam defining a bent current flow path between said contacts; and a passive beam fused to said active beam, such that when a current is passed through the active beam, the active beam heats and expands relative to the passive beam resulting in bending of the actuator, wherein said actuator has a working face for generating a positive pressure pulse in said ink during said bending of said actuator, said working face having an area of less than 800 square microns.

In a second aspect the present invention provides an inkjet printer comprising:

a printhead having a plurality of nozzles assemblies, each nozzle assembly comprising:

a nozzle chamber for containing ink, said chamber having a nozzle opening and an ink inlet; and a bend actuator for ejecting ink droplets from the nozzle opening by generating a positive pressure pulse in said ink during bending of the actuator; and an ink supply system for supplying ink to said printhead; and means for varying a hydrostatic pressure of ink supplied to said printhead, wherein increasing said hydrostatic ink pressure increases a volume of said ejected ink droplets, and decreasing said hydrostatic ink pressure decreases a volume of said ejected ink droplets.

Optionally, the volume of said ejected ink droplets may be increased by at least 100% relative to a minimum droplet volume.

Optionally, a printhead face is defined by a hydrophobic layer.

Optionally, said hydrophobic layer is a PDMS layer.

Optionally, said hydrophobic layer is deposited on a relatively hydrophilic nozzle plate.

Optionally, a meniscus of ink is pinned across each nozzle opening at a hydrophilic/hydrophilic interface.

Optionally, each nozzle assembly comprises drive circuitry for delivering actuation pulses to said bend actuator.

Optionally, said drive circuitry is configured such that each actuation pulse delivers less than 200 nJ of energy to said actuator.

Optionally, said bend actuator comprises:

an active beam connected to a pair of electrical contacts; and a passive beam mechanically cooperating with said active beam, such that when a current is passed through the active beam, the active beam heats and expands relative to the passive beam resulting in bending of the actuator.

Optionally, each nozzle assembly comprises said pair of electrical contacts positioned at one end thereof, and wherein said active beam extends longitudinally away from said contacts to defining a bent current flow path between said contacts.

Optionally, said active beam is fused to said passive beam.

Optionally, said active beam comprises a first arm extending longitudinally from a first contact, a second arm extending longitudinally from a second contact and a connecting member connecting said first and second arms.

Optionally, each of said first and second arms comprises a respective resistive heating element.

Optionally, said connecting member interconnects distal ends of said first and second arms, said distal ends being distal relative to said electrical contacts.

Optionally, said active beam is comprised of a material selected from the group comprising: titanium nitride, titanium aluminium nitride and a vanadium—aluminium alloy.

Optionally, said passive beam is comprised of a material selected from the group comprising: silicon dioxide, silicon nitride and silicon oxynitride.

Optionally, each nozzle chamber comprises a floor and a roof having a moving portion, whereby actuation of said actuator moves said moving portion towards said floor.

Optionally, said moving portion comprises said actuator.

Optionally, the nozzle opening is defined in the moving portion, such that the nozzle opening is moveable relative to the floor.

In a further aspect the present invention provides a method of configuring a printhead to eject ink droplets of a predetermined volume, said method comprising the steps of:

(i) providing a printhead having a plurality of nozzles assemblies, each nozzle assembly comprising:
  a nozzle chamber for containing ink, said chamber having a nozzle opening of a predetermined dimension; and
  a bend actuator for ejecting ink droplets from the nozzle opening by generating a positive pressure pulse in said ink during bending of the actuator;

(ii) varying a hydrostatic pressure of ink supplied to said printhead, thereby varying a volume of ejected ink droplets;

(iii) determining an optimal hydrostatic ink pressure corresponding to said predetermined volume; and (iii) configuring an ink supply system to supply ink to said printhead at said optimal hydrostatic ink pressure.

In a third aspect the present invention provides an inkjet printer configured for ejecting ink droplets having a volume in the range of 1 to 2.5 pL, said printer comprising:

a printhead having a plurality of nozzles assemblies, each nozzle assembly comprising:
  a nozzle chamber for containing ink, said chamber having a nozzle opening and an ink inlet, said nozzle opening having a maximum dimension in the range of 4 to 12 microns; and
  a bend actuator for ejecting ink droplets from the nozzle opening by generating a positive pressure pulse in said ink during bending of the actuator; and an ink supply system configured for supplying ink to said printhead at a positive hydrostatic pressure in the range of 1 to 300 mm $H_2O$.

Optionally, said nozzle opening has a maximum dimension in the range of 6 to 10 microns.

Optionally, said ink supply system is configured for supplying ink to said printhead at a positive hydrostatic pressure in the range of 5 to 200 mm $H_2O$.

Optionally, said hydrostatic pressure provides a convex meniscus at said nozzle opening when said printhead is primed.

Optionally, a printhead face is defined by a hydrophobic layer.

Optionally, said hydrophobic layer is a PDMS layer.

Optionally, said hydrophobic layer is deposited on a relatively hydrophilic nozzle plate.

Optionally, a meniscus of ink is pinned across each nozzle opening at a hydrophilic/hydrophilic interface.

Optionally, each nozzle assembly comprises drive circuitry for delivering actuation pulses to said bend actuator.

Optionally, said drive circuitry is configured such that each actuation pulse delivers less than 200 nJ of energy to said actuator.

Optionally, said bend actuator comprises:

an active beam connected to a pair of electrical contacts; and a passive beam mechanically cooperating with said active beam, such that when a current is passed through the active beam, the active beam heats and expands relative to the passive beam resulting in bending of the actuator.

Optionally, each nozzle assembly comprises said pair of electrical contacts positioned at one end thereof, and wherein said active beam extends longitudinally away from said contacts to defining a bent current flow path between said contacts.

Optionally, said active beam is fused to said passive beam.

Optionally, said active beam comprises a first arm extending longitudinally from a first contact, a second arm extending longitudinally from a second contact and a connecting member connecting said first and second arms.

Optionally, each of said first and second arms comprises a respective resistive heating element.

Optionally, said active beam is comprised of a material selected from the group comprising: titanium nitride, titanium aluminium nitride and a vanadium—aluminium alloy.

Optionally, said passive beam is comprised of a material selected from the group comprising: silicon dioxide, silicon nitride and silicon oxynitride.

Optionally, each nozzle chamber comprises a floor and a roof having a moving portion, whereby actuation of said actuator moves said moving portion towards said floor.

Optionally, said moving portion comprises said actuator.

Optionally, the nozzle opening is defined in the moving portion, such that the nozzle opening is moveable relative to the floor.

BRIEF DESCRIPTION OF THE DRAWINGS

Embodiments of the present invention will now be described by way of example only with reference to the accompanying drawings, in which.

DETAILED DESCRIPTION OF THE INVENTION

Thermal Bend Actuator Configured for Maximum Drop Ejection Velocity

Figure 1:
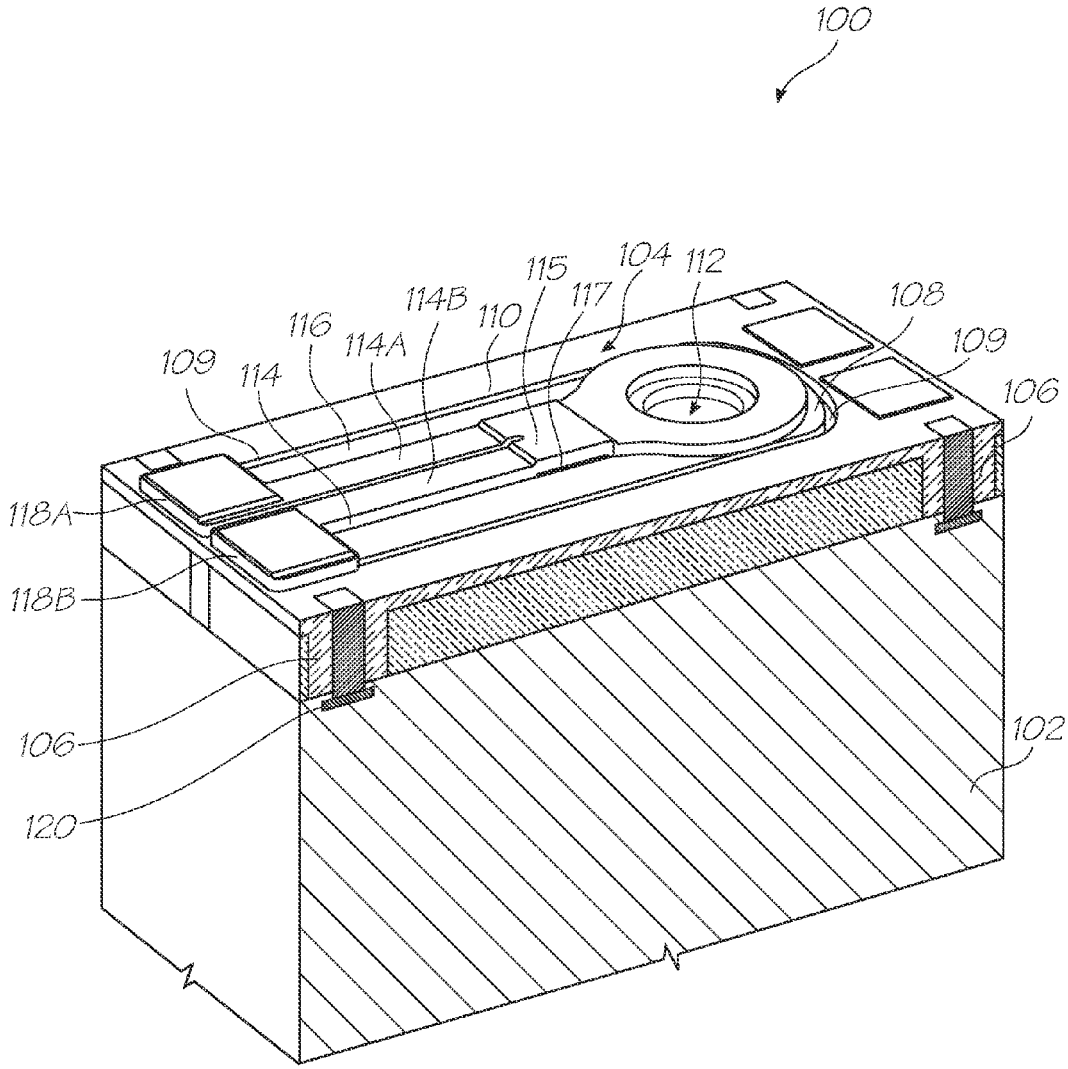
FIG. 1 is a cutaway perspective of a partially-fabricated inkjet nozzle assembly.
Figure 2:
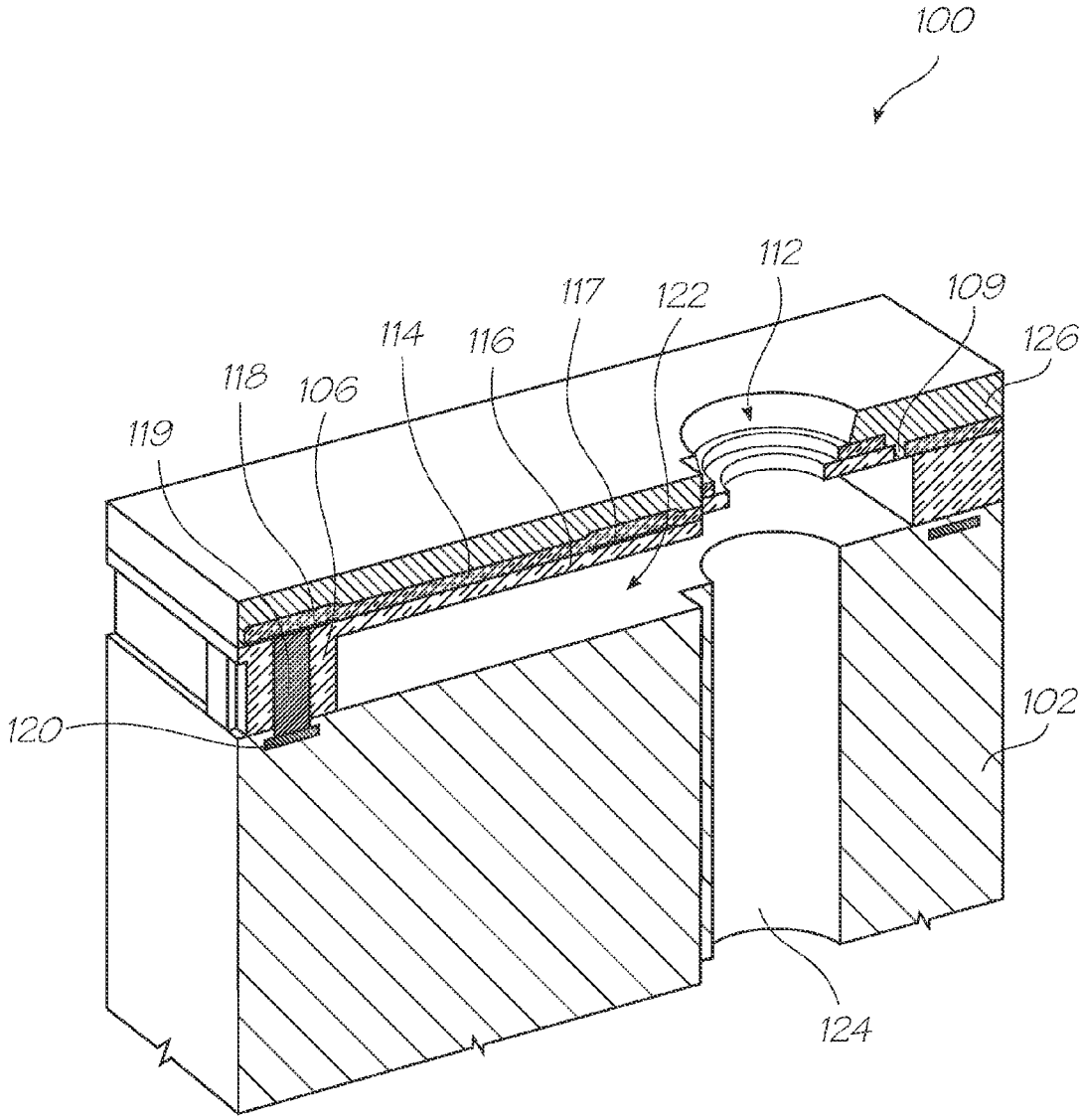
FIG. 2 is a cutaway perspective of the inkjet nozzle assembly shown in FIG. 1 after completion of final-stage fabrication steps.
Figure 3A:
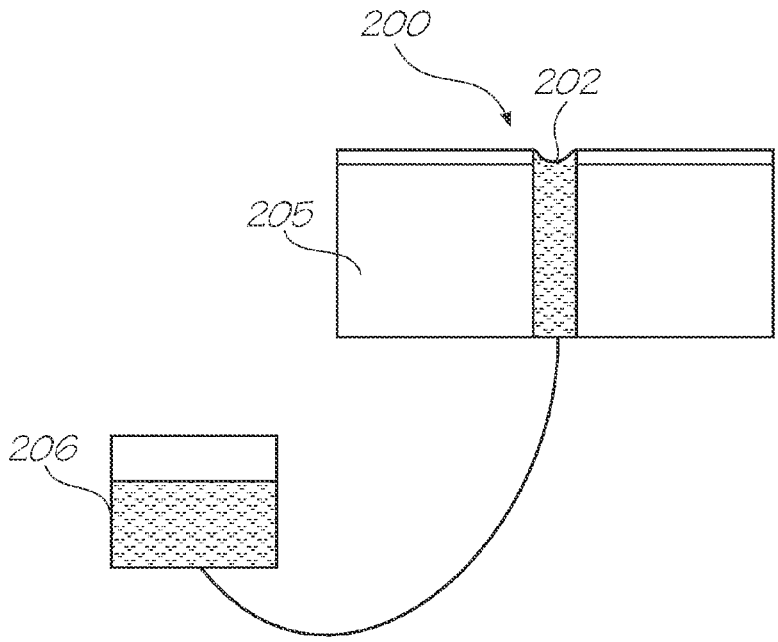
FIG. 3A shows schematically an arbitrary printhead supplied with ink at a negative hydrostatic pressure.
Figure 3B:
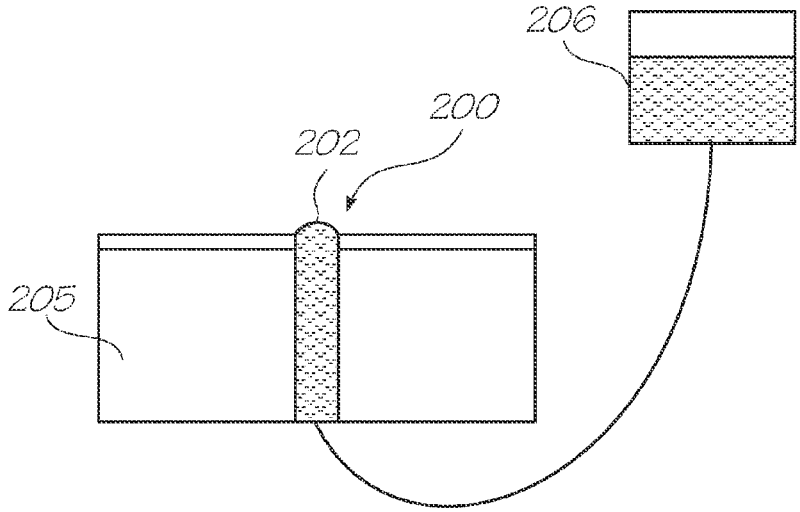
FIG. 3B shows schematically the arbitrary printhead supplied with ink at a positive hydrostatic pressure.

FIGS. 1 and 2 show a nozzle assembly 100 at two different stages of fabrication. The nozzle assembly is similar in construction to the nozzle assembly described in the Applicant's earlier filed U.S. application Ser. No. 11/763,440 filed on Jun. 15, 2007, the contents of which is incorporated herein by reference.

FIG. 1 shows the nozzle assembly partially formed so as to illustrate the features of active and passive beam layers. Thus, referring to FIG. 1, there is shown the nozzle assembly 100 formed on a CMOS silicon substrate 102. A nozzle chamber is defined by a roof 104 spaced apart from the substrate 102 and sidewalls 106 extending from the roof to the substrate 102. The roof 104 is comprised of a moving portion 108 and a stationary portion 110 with a gap 109 defined therebetween. A nozzle opening 112 is defined in the moving portion 108 for ejection of ink.

The moving portion 108 comprises a thermal bend actuator having a pair of cantilever beams in the form of an upper active beam 114 fused to a lower passive beam 116. The lower passive beam 116 defines the extent of the moving portion 108 of the roof. The upper active beam 114 comprises a pair of arms 114A and 114B which extend longitudinally from respective electrode contacts 118A and 118B. The arms 114A and 114B are connected at their distal ends by a connecting member 115. The connecting member 115 may comprise a titanium conductive pad 117, which facilitates electrical conduction around this join region. Hence, the active beam 114 defines a bent or tortuous conduction path between the electrode contacts 118A and 118B.

The electrode contacts 118A and 118B are positioned adjacent each other at one end of the nozzle assembly and are connected via respective connector posts 119 to a metal CMOS layer 120 of the substrate 102. The CMOS layer 120 contains the requisite drive circuitry for actuation of the bend actuator.

The passive beam 116 is typically comprised of any electrically and thermally-insulating material, such as silicon dioxide, silicon nitride etc. The thermoelastic active beam 114 may be comprised of any suitable thermoelastic material, such as titanium nitride, titanium aluminium nitride and aluminium alloys. As explained in the Applicant's copending U.S. application Ser. No. 11/607,976 filed on 4 Dec. 2006, vanadium—aluminium alloys are a preferred material, because they combine the advantageous properties of high thermal expansion, low density and high Young's modulus.

Referring to FIG. 2, there is shown a completed nozzle assembly 100 at a subsequent stage of fabrication. The nozzle assembly of FIG. 2 has a nozzle chamber 122 and an ink inlet 124 for supply of ink to the nozzle chamber. In addition, the roof 104, which defines part of a rigid nozzle plate for the printhead, is covered with a layer of polymeric material 126, such as polydimethylsiloxane (PDMS). The polymeric layer 126 has a multitude of functions, including: protection of the bend actuator, hydrophobizing the roof 104 (and printhead face) and providing a mechanical seal for the gap 109. The polymeric layer 126 has a sufficiently low Young's modulus to allow actuation and ejection of ink through the nozzle opening 112. A more detailed description of the polymeric layer 126, including its functions and fabrication, can be found in, for example, U.S. application Ser. No. 11/946,840 filed on Nov. 29, 2007, the contents of which is incorporated herein by reference.

When it is required to eject a droplet of ink from the nozzle chamber 122, a current flows through the active beam 114 between the electrode contacts 118. The active beam 114 is rapidly heated by the current and expands relative to the passive beam 116, thereby causing the moving portion 108 to bend downwards towards the substrate 102 relative to the stationary portion 110. This movement, in turn, causes ejection of ink from the nozzle opening 112 by a rapid increase of pressure inside the nozzle chamber 122. When current stops flowing, the moving portion 108 is allowed to return to its quiescent position, shown in FIGS. 1 and 2, which sucks ink from the inlet 124 into the nozzle chamber 122, in readiness for the next ejection.

In the nozzle design shown in FIGS. 1 and 2, it is advantageous for the bend actuator to define at least part of the moving portion 108 of each nozzle assembly 100. This not only simplifies the overall design and fabrication of the nozzle assembly 100, but also provides higher ejection efficiency because only one face (that is, a lower "working face") of the moving portion 108 has to do work against the relatively viscous ink. By comparison, nozzle assemblies having an actuator paddle positioned inside the nozzle chamber 122 are less efficient, because both faces of the actuator have to do work against the ink inside the chamber.

However, there is still a need to improve the overall efficiency of the bend actuator. In accordance with the present invention, the working face of the thermal bend actuator has an area of less than 800 square microns. Optionally, the working face has an area of less than 700 square microns or less than 600 square microns.

As shown in FIGS. 1 and 2, the working face of the thermal bend actuator is usually defined by the lower surface (interior surface) of the passive beam 116, which does work against ink contained in the nozzle chamber 122.

A reduction in the area of the working face of the thermal bend actuator represents a significant departure from previous designs of thermal bend actuators. Hitherto, it was understood that the displacement of a requisite volume of ink was the primary factor governing droplet ejection from the nozzle opening. Hence, in order to achieve typical ink droplet volumes of 1-2 pL (e.g. 1.2-1.8 pL) at acceptable drop ejection velocities (e.g. 5-15 m/s), it was previously understood that displacement of a working face having an area of at least 1500 square microns was required. Efforts to improve drop ejection characteristics had previously focused on maximizing actuator displacement, which is usually achieved by lengthening the actuator and thereby increasing the area of its working surface. However, the Applicant's experiments have now found that, contrary to expectations, a peak velocity of the actuator during bend actuation is a more significant factor in providing optimal drop ejection, in terms of acceptable drop velocity and droplet volume.

Provided that a sufficient peak actuator velocity is achieved, excellent drop ejection results, even with a relatively low surface area working face. A sufficiently high peak actuator velocity is typically at least about 2.5 m/s.

Peak actuator velocity may be controlled by how rapidly the active beam is heated during actuation. As explained in the Applicant's U.S. application Ser. No. 12/114,826 filed on May 5, 2008 (the contents of which is incorporated herein by reference), rapid heating of the active beam may be achieved by a relatively short actuation pulse-width of less than 0.2 microseconds (e.g. about 0.1 microseconds) and/or an active beam comprising heating elements with relatively low cross-sectional area (e.g. less than 10 square microns or less than 5 square microns). Typically, each heating element has a width of less than 5 microns.

However, peak actuator velocity is also a function of the area of the working face, because less work is done against the ink when the working face has a lower area. It has been found that optimal drop ejection characteristics are achieved in the present invention when the working face has an area of from 200 to 800 square microns, or from 250 to 700 square microns or from 300 to 650 square microns. When such working faces are displaced with a peak velocity of at least 2.5 m/s, an acceptable drop ejection velocity of 6-12 m/s or 8-10 m/s typically results From the foregoing, it will be understood that the present invention provides a significant reduction in the area of the working face in an inkjet nozzle assembly comprising a thermal bend actuator. Accordingly, the footprint area of each inkjet nozzle assembly can be reduced, which enables denser packing of nozzles on an inkjet printhead. Typically, a footprint area of each nozzle assembly in a printhead according to the present invention is less than 1200 square microns, or less than 1000 square microns, or less than 800 square microns.

More specifically, the area of the working face may be reduced by a thermal bend actuator having a length of less than 60 microns or less than 50 microns. Reducing the length of the actuator increases the stiffness of the actuator in a bend direction, which further improves the overall efficiency of actuator. The stiffness of the actuator in the bend direction is also governed by the overall thickness of the actuator. Optionally, the bend actuator has a thickness of at least 1.3 microns or at least 1.5 microns.

Furthermore, the area of the working face may be reduced by a thermal bend actuator having a width of less than 20 microns or less than 15 microns. Reducing the width of the actuator has the greatest effect in increasing nozzle packing density on the printhead, since a greater number of nozzles may be fitted into one row of nozzles.

Ultimately, the present invention achieves both a high nozzle packing density together with excellent drop ejection efficiency and excellent droplet characteristics. For example, an input energy of less than 200 nJ (or less than 150 nJ), when delivered in a pulse width of about 0.1 microsecond, is sufficient to generate a peak actuator velocity of at least 2.5 m/s. This results in a droplet ejection velocity of 8-10 m/s.

Moreover, the ejected ink droplets are well-formed and, surprisingly, have little or no satellite droplets. Satellite droplets are well-known in inkjet printing and result from break-up of the tail of an ejected droplet into microscopic satellite droplets, which are detached from the main ink droplet. Satellite droplets are problematic and potentially affect overall print quality. It is understood by the present inventors that relatively high peak actuator velocities of at least 2.5 m/s are responsible for reducing the number of satellite droplets. Usually, satellite droplets are associated with high drop ejection velocities, but the present invention, surprisingly, exhibits few satellite droplets even at relatively high drop ejection velocities of at least 7 m/s, at least 8 m/s or at least 9 m/s.

In summary, the peak displacement of the actuator in combination with a relatively large working face area appears to be a far less significant factor than the peak actuator velocity in controlling drop ejection characteristics; and by minimizing the area of the working face, greater peak actuator velocities can be achieved for a given input energy.

Control of Droplet Size Using Ink Pressure

Figure 4:
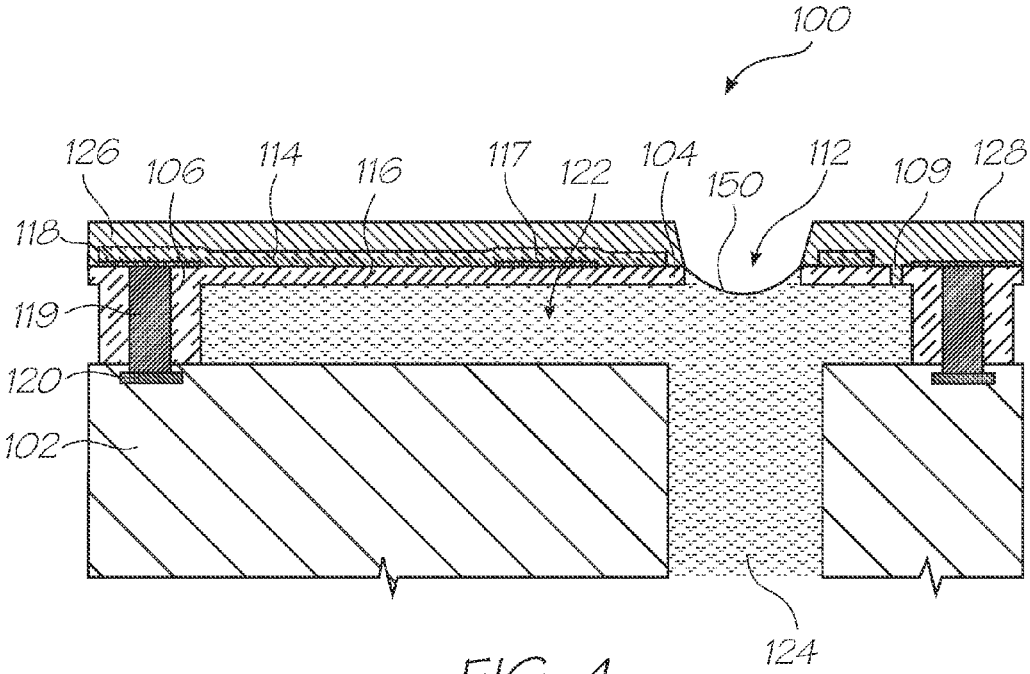
FIG. 4 shows an inkjet nozzle assembly primed with ink at a negative hydrostatic pressure.

Most inkjet printers operate at negative hydrostatic ink pressures. This is primarily to avoid ink flooding uncontrollably across a printhead face, especially when printing ceases. Moreover, when a meniscus of ink is pinned across a nozzle opening by surface tension, it is preferable to have a concave meniscus as opposed to a convex meniscus (bulging outwards from the printhead), because a convex meniscus is easily burst by particulates on the printhead face resulting in microflooding. FIG. 4A shows a typical inkjet nozzle 200 having a concave meniscus 202 by virtue of a negative hydrostatic ink pressure, while FIG. 4B shows the same inkjet nozzle having a convex meniscus 204 by virtue of a positive hydrostatic pressure.

Various means are known for controlling the hydrostatic ink pressure in an inkjet printhead. A suitably configured ink supply system can deliver ink at a requisite ink pressure, and many different forms of ink supply system are known. For example, a position of an ink reservoir relative to the printhead can provide a very simple form of pressure control—an ink reservoir 206 positioned above the printhead 205 provides positive hydrostatic ink pressure (see FIG. 4B); and the ink reservoir 206 positioned below the printhead 205 provides negative hydrostatic ink pressure (see FIG. 4A). Other means for controlling hydrostatic ink pressure in a printhead will be well within the ambit of the person skilled in the art, and a details of specific pressure-controlling means are not germane to the present invention.

Figure 5:
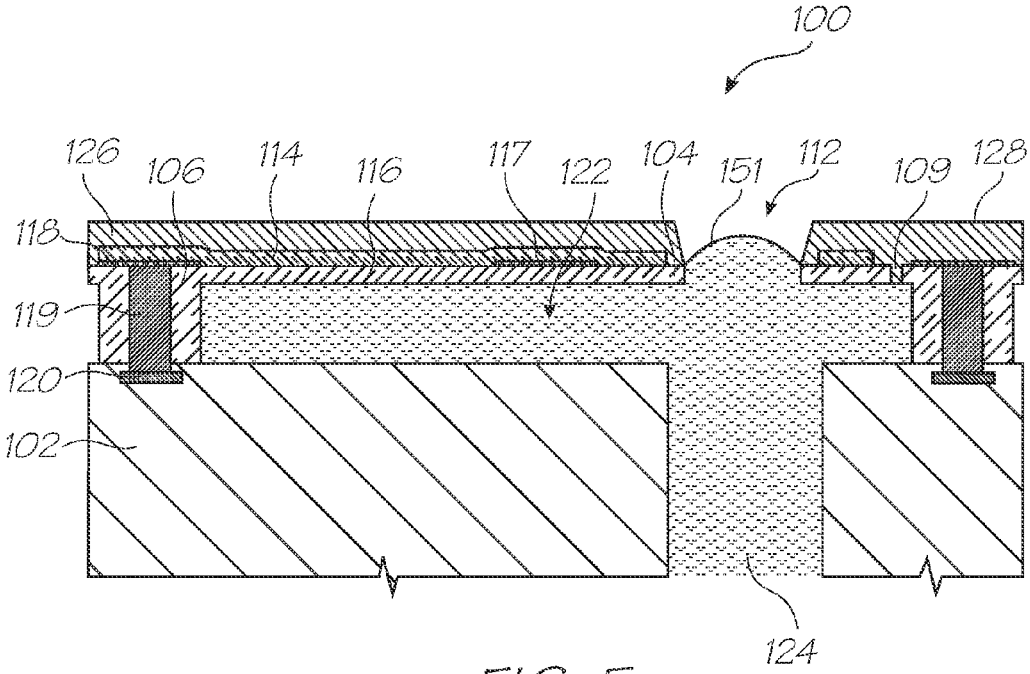
FIG. 5 shows an inkjet nozzle assembly primed with ink at a positive hydrostatic pressure.

As discussed above, the present Applicant has developed inkjet printheads having a hydrophobic surface. This is typically the PDMS layer 126, which is deposited onto the nozzle roof 104 at a late stage of printhead fabrication (see, for example, Applicant's U.S. application Ser. No. 11/946,840 filed on Nov. 29, 2007). Since the roof 104 of the nozzle chamber is generally hydrophilic, being formed from silicon dioxide or silicon nitride, a meniscus of ink pins across the nozzle opening 112 at the hydrophilic/hydrophobic interface defined between the roof layer 104 and the PDMS layer 126. FIG. 5 shows a concave meniscus 150 of ink in the nozzle arrangement 100 described above, with a negative hydrostatic ink pressure.

Figure 6:
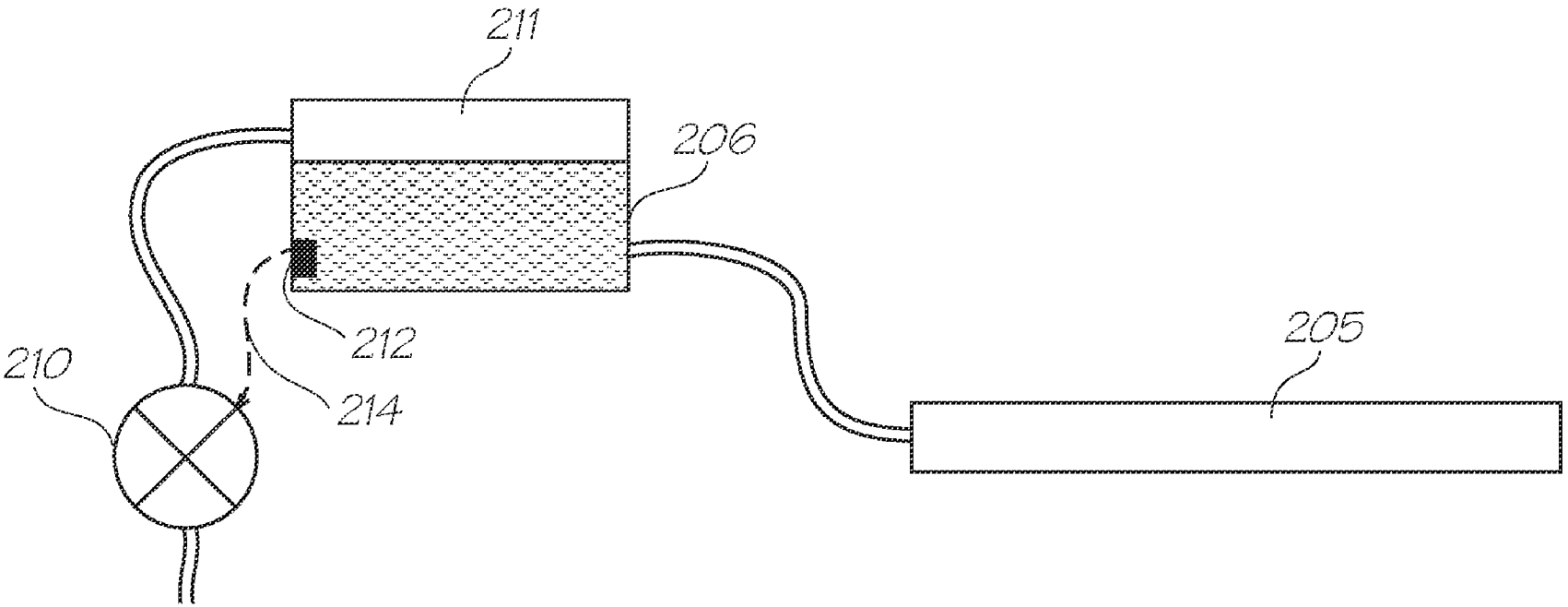
FIG. 6 shows schematically an inkjet printer having an ink supply system configured for supplying ink at varying hydrostatic pressures.

As explained in U.S. application Ser. No. 11/946,840, the hydrophobic PDMS layer 126 helps to minimize printhead face flooding. Accordingly, the PDMS layer 126 enables the possibility of a convex meniscus without such a high risk of printhead face flooding. As shown in FIG. 6, the convex meniscus 151 does not protrude from the printhead face (defined by an outer surface 128 of the PDMS layer) due to the thickness of the PDMS layer 126 and due to the fact that the meniscus 151 is pinned at the hydrophilic/hydrophobic interface. The PDMS layer 126 effectively shields the meniscus 151 from any particulates, whilst acting as an energy barrier which minimizes printhead face flooding—the ink has minimal tendency to move onto the hydrophobic PDMS layer 126 by capillary action and finds it energetically more favorable to remain pinned at the hydrophilic/hydrophobic interface.

Thus, the PDMS layer 126 does not constrain the nozzle assembly 100 to be used in combination with a negatively pressured ink supply. Without the constraint of a negative hydrostatic ink pressure, the Applicant's experiments have found that a positive hydrostatic ink pressure with convex meniscus 151, surprisingly, provides very different drop ejection characteristics in the bend-actuated nozzle assemblies 100 described herein.

A surprising observation is that for a given size (e.g. diameter) of nozzle opening 112, a positive hydrostatic ink pressure provides ejected ink droplets of larger size and volume than the same nozzle opening to which ink is supplied at a negative hydrostatic ink pressure. Hitherto, it was understood that the major factor governing ink droplet volume was the diameter of the nozzle opening 112. Typically, an ejected ink droplet is expected to have the same diameter as a nozzle opening from which it emanates. Thus, a nozzle opening having a diameter of 12 microns typically ejects ink droplets of about 0.9 pL (which may be too small for some applications). A 14 micron nozzle opening typically ejects ink droplets of about 1.4 pL (which is considered to be an acceptable drop volume for most inkjet applications). Generally, a drop volume in the range of 1-2.5 pL, or 1-2 pL is considered to be an acceptable drop volume.

However, ejected ink droplets were observed to be up to 1.5 times, up to 2 times, or up to 3 times larger in volume when ejected from the nozzle assembly shown in FIG. 6 having a positive hydrostatic ink pressure, compared to the nozzle assembly shown in FIG. 5 having a negative hydrostatic ink pressure.

Consequently, printheads having bend-actuated nozzles 100 may be designed differently or operated differently depending on the hydrostatic ink pressure provided by an ink supply system. For example, for a requisite droplet volume, a nozzle opening may be made smaller if a positive hydrostatic ink pressure is used, as compared to a more usual negative hydrostatic pressure. This, in turn, allows denser packing of nozzles on the printhead by virtue of the smaller-sized nozzle opening. Typically, the positive hydrostatic pressure may be in the range of 1 to 300 $mmH_2O$, optionally in the range of 5 to 200 $mmH_2O$, or optionally in the range of 10 to 100 $mmH_2O$. With such positive ink pressures, a nozzle opening may have a maximum dimension in the range of 4 to 12 microns, or optionally 5 to 11 microns, or optionally 6-10 microns, and still achieve acceptable drop volumes. For a circular nozzle opening, the maximum dimension is its diameter; for an elliptical nozzle opening, the maximum dimension is the length of its major axis.

Moreover, a printhead may be operated differently in situ by varying the hydrostatic pressure provided by an ink supply system. Some printhead applications (e.g. plain black text printing) may require larger droplets volumes by operating at positive hydrostatic pressure. Larger drop volumes put down more ink onto a page and maximize optical density, which is particularly desirable when printing black text onto standard office paper. Alternatively, some printhead applications (e.g. photo printing) may require smaller droplet volumes by operating at a lower (e.g. negative) hydrostatic ink pressure. Smaller drop volumes achieve higher print resolution, which is especially desirable for photo-printing applications.

The ability to vary droplet volume without fundamentally changing a nozzle design has significant ramifications for inkjet printing. It is a goal of inkjet printing to provide a SOHO printer, which is capable of printing both plain black text and/or photos without compromising on optical density or photo quality, respectively. Likewise, the ability to optimize drop volume in situ for printing onto different paper types represents a significant development in inkjet printer technology.

By way of example, FIGS. 4A and 4B show schematically a printer comprising an arbitrary printhead 205 and an ink supply system, which can deliver different hydrostatic ink pressures by varying a height of the ink reservoir 206 relative to the printhead. Of course, more sophisticated means of varying hydrostatic ink pressure in situ, via the ink supply system, will be readily apparent to the person skilled in the art. For example, as shown in FIG. 7, a reversible air pump 210 communicating with a headspace 211 in an ink reservoir 206, and an ink pressure sensor 212 providing a feedback signal 214 to the air pump may be used.

It will, of course, be appreciated that the present invention has been described by way of example only and that modifications of detail may be made within the scope of the invention, which is defined in the accompanying claims.

The invention claimed is:

1. An inkjet printer configured for ejecting ink droplets having a volume in the range of 1 to 2.5 pL, said printer comprising:

a printhead having a plurality of nozzles assemblies, each nozzle assembly comprising:

a nozzle chamber for containing ink, said chamber having a nozzle opening and an ink inlet, said nozzle opening having a maximum dimension in the range of 4 to 12 microns; and a bend actuator for ejecting ink droplets from the nozzle opening by generating a positive pressure pulse in said ink during bending of the actuator; and an ink supply system configured for supplying ink to said printhead at a positive hydrostatic pressure in the range of 1 to 300 mm $H_2O$.

2. The printer of claim 1, wherein said nozzle opening has a maximum dimension in the range of 6 to 10 microns.

3. The printer of claim 1, wherein said ink supply system is configured for supplying ink to said printhead at a positive hydrostatic pressure in the range of 5 to 200 mm $H_2O$.

4. The printer of claim 1, wherein said hydrostatic pressure provides a convex meniscus at said nozzle opening when said printhead is primed.

5. The printer of claim 1, wherein a printhead face is defined by a hydrophobic layer.

6. The printer of claim 5, wherein said hydrophobic layer is a PDMS layer.

7. The printer of claim 5, wherein said hydrophobic layer is deposited on a relatively hydrophilic nozzle plate.

8. The printer of claim 7, wherein a meniscus of ink is pinned across each nozzle opening at a hydrophilic/hydrophilic interface.

9. The printer of claim 1, wherein each nozzle assembly comprises drive circuitry for delivering actuation pulses to said bend actuator.

10. The printer of claim 1, wherein said drive circuitry is configured such that each actuation pulse delivers less than 200 nJ of energy to said actuator.

11. The printer of claim 1, wherein said bend actuator comprises:

an active beam connected to a pair of electrical contacts; and a passive beam mechanically cooperating with said active beam, such that when a current is passed through the active beam, the active beam heats and expands relative to the passive beam resulting in bending of the actuator.

12. The printer of claim 11 wherein each nozzle assembly comprises said pair of electrical contacts positioned at one end thereof, and wherein said active beam extends longitudinally away from said contacts to defining a bent current flow path between said contacts.

13. The inkjet nozzle assembly of claim 12, wherein said active beam comprises a first arm extending longitudinally from a first contact, a second arm extending longitudinally from a second contact and a connecting member connecting said first and second arms.

14. The printer of claim 13, wherein each of said first and second arms comprises a respective resistive heating element.

15. The printer of claim 11, wherein said active beam is fused to said passive beam.

16. The printer of claim 11, wherein said active beam is comprised of a material selected from the group comprising: titanium nitride, titanium aluminium nitride and a vanadium-aluminium alloy.

17. The printer of claim 11, wherein said passive beam is comprised of a material selected from the group comprising: silicon dioxide, silicon nitride and silicon oxynitride.

18. The printer of claim 1, wherein each nozzle chamber comprises a floor and a roof having a moving portion, whereby actuation of said actuator moves said moving portion towards said floor.

19. The printer of claim 17, wherein said moving portion comprises said actuator.

20. The printer of claim 18, wherein the nozzle opening is defined in the moving portion, such that the nozzle opening is moveable relative to the floor.

* * * * *